US009612565B2

(12) United States Patent
Hiroe

(10) Patent No.: US 9,612,565 B2
(45) Date of Patent: Apr. 4, 2017

(54) DRIVE MECHANISM AND IMAGE FORMING APPARATUS

(71) Applicant: FUJI XEROX Co., Ltd., Tokyo (JP)

(72) Inventor: Nobuhiro Hiroe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/691,622

(22) Filed: Apr. 21, 2015

(65) Prior Publication Data

US 2016/0077484 A1 Mar. 17, 2016

(30) Foreign Application Priority Data

Sep. 17, 2014 (JP) ..... 2014-189429

(51) Int. Cl.
*G03G 15/00* (2006.01)
*G03G 21/16* (2006.01)

(52) U.S. Cl.
CPC ..... *G03G 15/757* (2013.01); *G03G 21/1647* (2013.01)

(58) Field of Classification Search
CPC ..... G03G 15/0189; G03G 15/757; G03G 21/1647
See application file for complete search history.

(56) References Cited

U.S. PATENT DOCUMENTS 5,848,309 A * 12/1998 Shimizu ..... G03B 17/425 396/408

FOREIGN PATENT DOCUMENTS

JP 2005-054861 A 3/2005
JP 2012-133385 A 7/2012

* cited by examiner

*Primary Examiner* — David Gray
*Assistant Examiner* — Andrew V Do
(74) *Attorney, Agent, or Firm* — Sughrue Mion, PLLC

(57) ABSTRACT

A drive mechanism includes a first transmission mechanism that transmits a driving force of a drive unit to a first rotary member to rotate the first rotary member; a second transmission mechanism including a first drive path along which the second transmission mechanism transmits the driving force to a second rotary member through a first gear train to rotate the second rotary member, and a second drive path along which the second transmission mechanism transmits the driving force to the second rotary member through a second gear train to rotate the second rotary member, the second gear train having a gear ratio that differs from a gear ratio of the first gear train; and a switching mechanism that is operated by the driving force and switches the second transmission mechanism between the first drive path and the second drive path.

10 Claims, 8 Drawing Sheets

DRIVE MECHANISM AND IMAGE FORMING APPARATUS

CROSS-REFERENCE TO RELATED APPLICATIONS

This application is based on and claims priority under 35 USC 119 from Japanese Patent Application No. 2014-189429 filed Sep. 17, 2014.

BACKGROUND (i) Technical Field

The present invention relates to a drive mechanism and an image forming apparatus.

(ii) Related Art

An example of a rotary-member rotating structure rotates a first rotary member and a second rotary member with a single drive unit. Such a structure may include a switching mechanism for switching a gear train for transmitting a driving force to, for example, the second rotary member between gear trans having different gear ratios. In such a case, if a drive unit for operating the switching mechanism is provided in addition to the drive unit for rotating the first and second rotary members, the number of drive units is increased.

SUMMARY

According to an aspect of the invention, there is provided a drive mechanism including a first transmission mechanism that transmits a driving force of a drive unit to a first rotary member to rotate the first rotary member; a second transmission mechanism including a first drive path along which the second transmission mechanism transmits the driving force of the drive unit to a second rotary member through a first gear train to rotate the second rotary member, and a second drive path along which the second transmission mechanism transmits the driving force of the drive unit to the second rotary member through a second gear train to rotate the second rotary member, the second gear train having a gear ratio that differs from a gear ratio of the first gear train; and a switching mechanism that is operated by the driving force of the drive unit and switches the second transmission mechanism between the first drive path and the second drive path.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described with reference to the drawings.

Structure of Image Forming Apparatus 10

Figure 1:
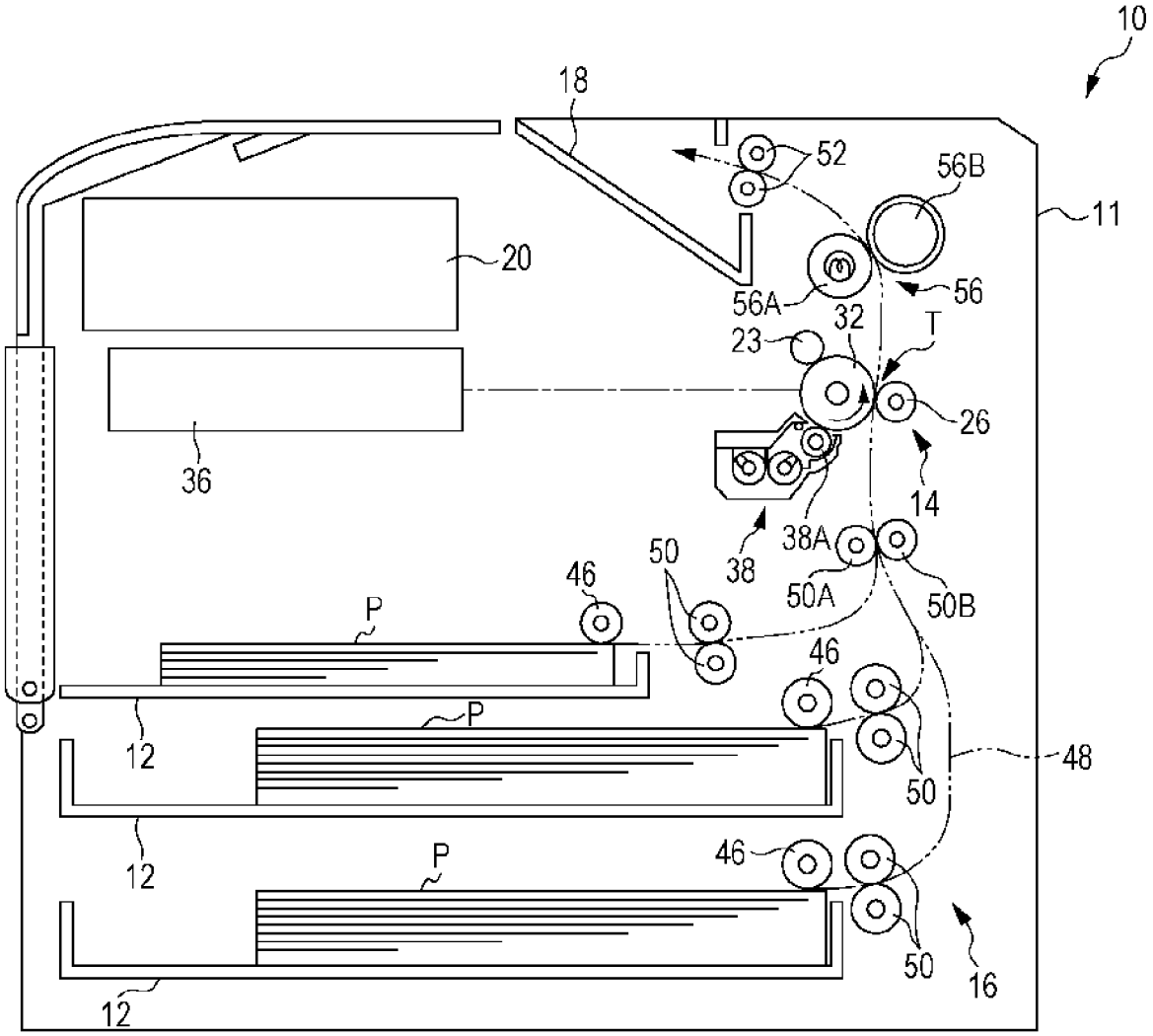
FIG. 1 is a schematic diagram illustrating the structure of an image forming apparatus according to an exemplary embodiment.

First, the structure of an image forming apparatus 10 will be described. FIG. 1 is a schematic diagram illustrating the structure of the image forming apparatus 10.

As illustrated in FIG. 1, the image forming apparatus 10 includes an apparatus body 11 that contains various components. The components contained in the apparatus body 11 include plural containers 12 that contain recording media P, such as paper sheets, an image forming unit 14 that forms images on the recording media P, a transport unit 16 that transports the recording media P from the containers 12 to the image forming unit 14, and a controller 20 that controls the operation of each component of the image forming apparatus 10. An ejection unit 18 is provided in an upper section of the apparatus body 11. The recording media P on which the images have been formed by the image forming unit 14 are ejected to the ejection unit 18.

The image forming unit 14 includes a photoconductor drum 32 (example of a photoconductor) which serves as an image carrier that carries an image. The photoconductor drum 32 rotates in one direction (for example, counterclockwise in FIG. 1). A charging roller 23, an exposure device 36, a developing device 38, and a transfer roller 26 are arranged around the photoconductor drum 32 in that order from an upstream position in the rotational direction of the photoconductor drum 32. The charging roller 23 serves as a charging device for charging the photoconductor drum 32. The exposure device 36 irradiates the photoconductor drum 32 charged by the charging roller 23 with light to form an electrostatic latent image on the photoconductor drum 32. The developing device 38 forms a black toner image by developing the electrostatic latent image formed on the photoconductor drum 32 by the exposure device 36. The transfer roller 26 transfers the black toner image formed on the photoconductor drum 32 by the developing device 38 onto a recording medium P.

The exposure device 36 forms the electrostatic latent image on the basis of an image signal transmitted from the controller 20. The image signal transmitted from the controller 20 may be, for example, a signal acquired by the controller 20 from an external device. The developing device 38 includes a developing roller 38A that rotates while retaining developer so that the developer is supplied to the photoconductor drum 32.

The transfer roller 26 opposes the photoconductor drum 32, and is configured such that the recording medium P is transported upward while being nipped between the transfer roller 26 and the photoconductor drum 32. The position between the transfer roller 26 and the photoconductor drum 32 serves as a transfer position T at which the toner image formed on the photoconductor drum 32 is transferred onto the recording medium P.

The transport unit 16 includes feed rollers 46 for feeding the recording media P contained in the containers 12, transport paths 48 along which the recording media P fed by the feed rollers 46 are transported, and plural transport rollers 50 that are arranged along the transport paths 48 and that transport the recording media P fed by the feed rollers 46 to the transfer position T. The transport rollers 50 include registration rollers 50A and 50B which supply each recording medium P to the transfer position T at the time when the toner image on the photoconductor drum 32 reaches the transfer position T, so that the toner image and the recording medium P are positioned relative to each other. The registration roller 50A is, for example, a driving roller, and the registration roller 50B is, for example, a driven roller that is rotated by the rotation of the registration roller 50A. The registration rollers 50A and 50B may instead be a driven roller and a driving roller, respectively. Alternatively, the registration rollers 50A and 50B may both be driving rollers.

A fixing device 56 is provided above the transfer position T, that is, on the downstream side of the transfer position T in the transporting direction. The fixing device 56 fixes the toner image that has been transferred onto the recording medium P by the transfer roller 26 to the recording medium P. Ejection rollers 52 for ejecting the recording medium P having the toner image fixed thereto to the ejection unit 18 are provided above the fixing device 56, that is, on the downstream side of the fixing device 56 in the transporting direction.

The fixing device 56 includes a heating roller 56A and a pressing roller 56B. The fixing device 56 fixes the toner image to the recording medium P by applying heat with the heating roller 56A and pressure with the pressing roller 56B while nipping the recording medium P between the heating roller 56A and the pressing roller 56B that rotate and transporting the recording medium P. The heating roller 56A is, for example, a driving roller, and the pressing roller 56B is, for example, a driven roller that is rotated by the rotation of the heating roller 56A. The heating roller 56A and the pressing roller 56B may instead be a driven roller and a driving roller, respectively. Alternatively, the heating roller 56A and the pressing roller 56B may both be driving rollers.

Drive Mechanism 60

A drive mechanism 60 that rotates the photoconductor drum 32 (example of a first rotary member), the developing roller 38A (example of a first rotary member), the registration roller 50A (example of a second rotary member), and the heating roller 56A (example of a second rotary member) will now be described. In FIGS. 2 to 7 described below, teeth on each gear of the drive mechanism 60 are not illustrated, and it is to be assumed that gears with the circumferences touching each other mesh with each other.

Figure 2:
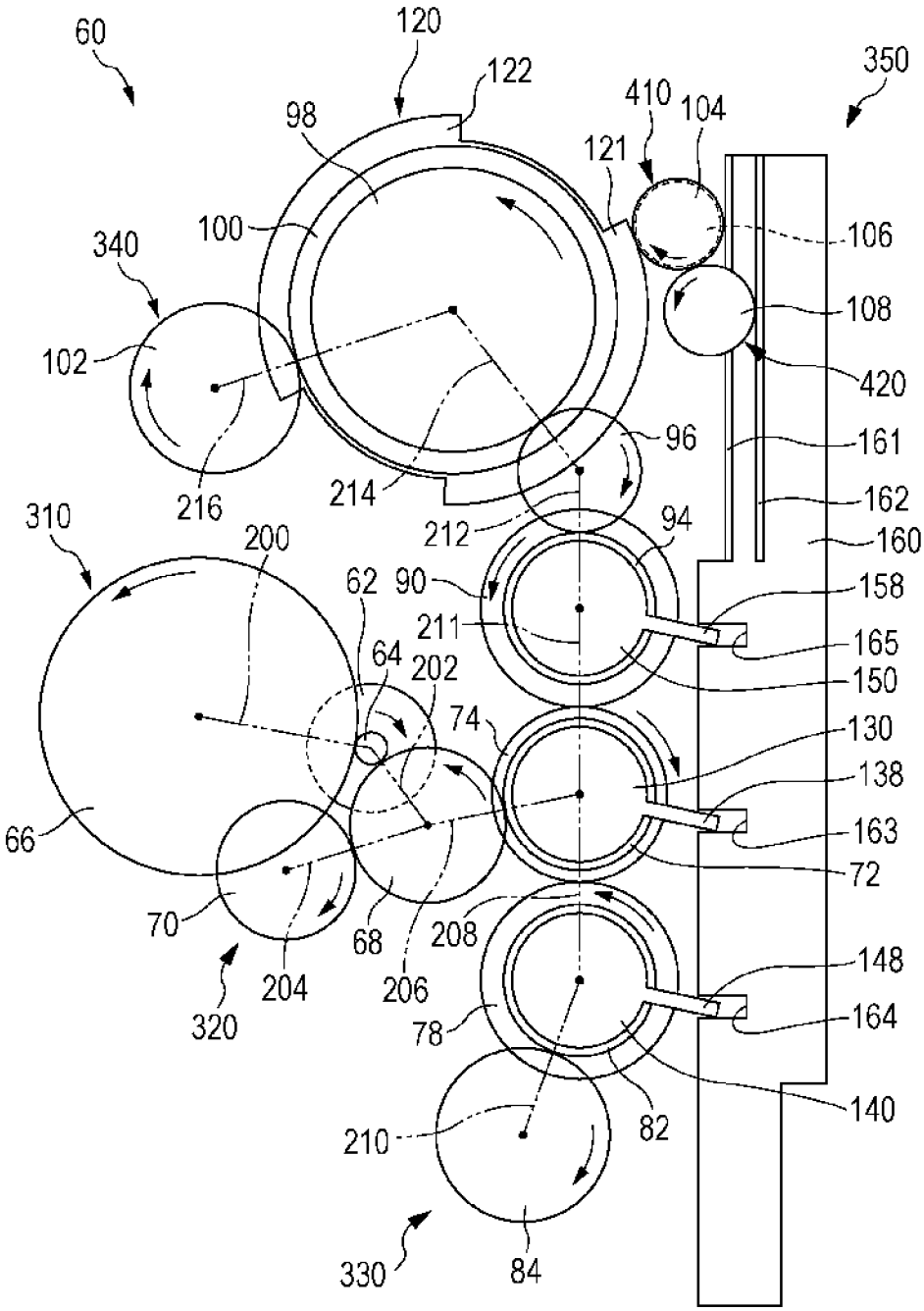
FIG. 2 is a schematic diagram illustrating the structure of a drive mechanism according to the exemplary embodiment.
Figure 3:
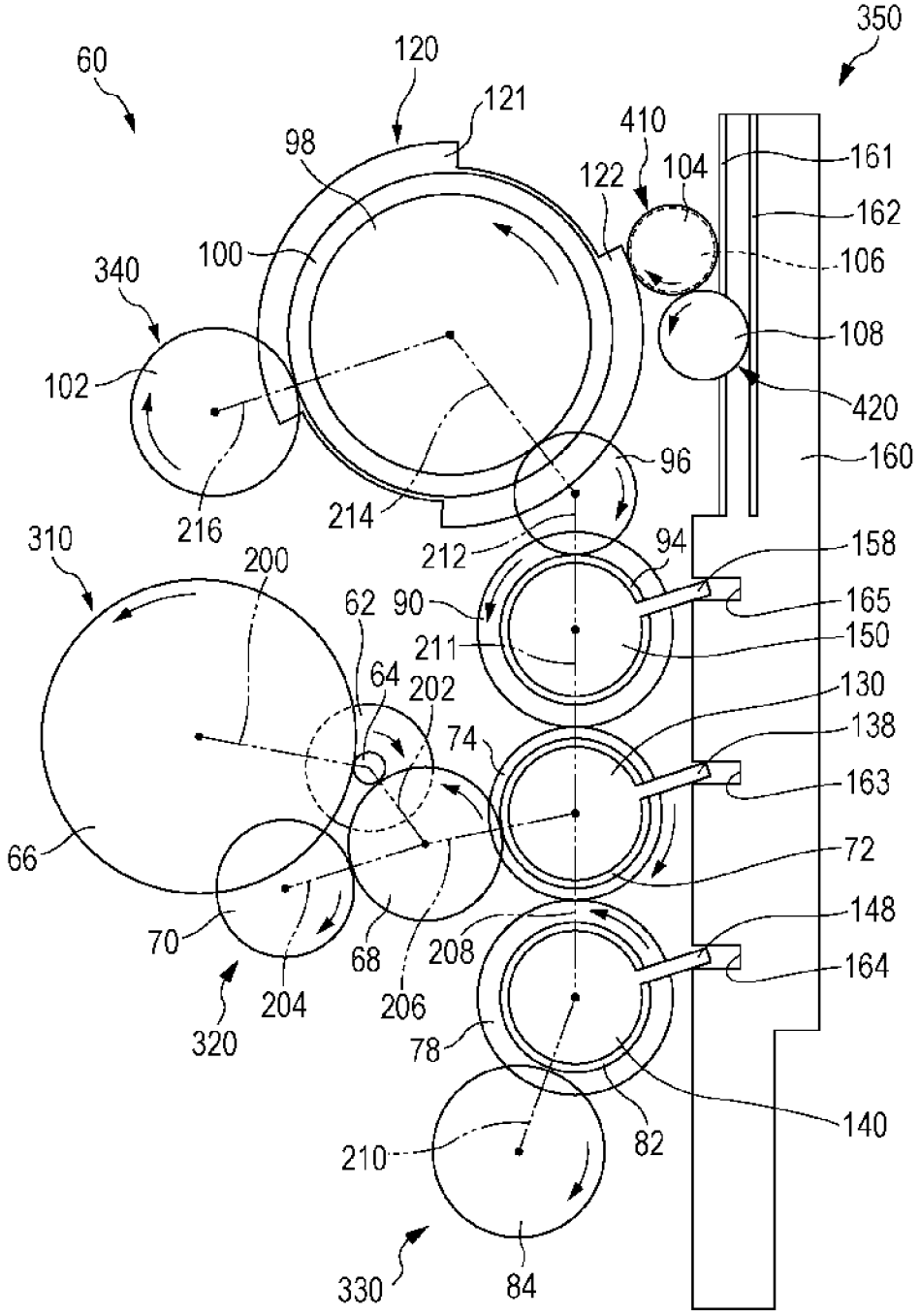
FIG. 3 is a schematic diagram illustrating the structure of FIG. 2 in the state in which a rack is moved upward.

As illustrated in FIGS. 2 and 3, the drive mechanism 60 includes a drive motor 62 as an example of a drive unit. The drive mechanism 60 also includes transmission mechanisms 310, 320, 330, and 340 for transmitting a driving force of the drive motor 62 to the photoconductor drum 32 (see FIG. 1), the developing roller 38A (see FIG. 1), the registration roller 50A (see FIG. 1), and the heating roller 56A (see FIG. 1).

Transmission Mechanism 310 for Transmitting Driving Force of Drive Motor 62 to Photoconductor Drum 32

As illustrated in FIGS. 2 and 3, the transmission mechanism 310 (example of a first transmission mechanism) includes a drive gear 64 provided on a drive shaft (not shown) of the drive motor 62 and rotated by the driving force of the drive motor 62, and a gear 66 that meshes with the drive gear 64. The transmission mechanism 310 also includes a gear (not shown) fixed to a rotating shaft of the photoconductor drum 32 (see FIG. 1). The transmission mechanism 310 is formed of a gear train including the gear fixed to the rotating shaft of the photoconductor drum 32, the drive gear 64, and the gear 66. The gear train transmits the driving force of the drive motor 62 to the photoconductor drum 32 so that the photoconductor drum 32 is rotated. The transmission path from the drive gear 64 to the gear 66 is shown by a two-dot chain line 200 in FIG. 2. The gear 66 may instead be directly fixed to the rotating shaft of the photoconductor drum 32.

In the present exemplary embodiment, the drive motor 62 does not rotate in both positive and reverse directions, but is structured such that the drive gear 64 (drive shaft) rotates in one direction (clockwise in FIG. 2).

Transmission Mechanism 320 for Transmitting Driving Force of Drive Motor 62 to Developing Roller 38A As illustrated in FIGS. 2 and 3, the transmission mechanism 320 (example of a first transmission mechanism) includes the drive gear 64, a gear 68 that meshes with the drive gear 64, and a gear 70 that meshes with the gear 68. The transmission mechanism 320 also includes a gear (not shown) fixed to a rotating shaft of the developing roller 38A. The transmission mechanism 320 is formed of a gear train including the gear fixed to the rotating shaft of the developing roller 38A, the drive gear 64, and the gears 68 and 70. The gear train transmits the driving force of the drive motor 62 to the developing roller 38A so that the developing roller 38A is rotated. The transmission path from the drive gear 64 to the gear 70 is shown by two-dot chain lines 202 and 204 in FIG. 2. The gear 70 may instead be directly fixed to the rotating shaft of the developing roller 38A.

Transmission Mechanism 330 for Transmitting Driving Force of Drive Motor 62 to Registration Roller 50A As illustrated in FIGS. 2 and 3, the transmission mechanism 330 (example of a second transmission mechanism) includes the drive gear 64, the gear 68, a gear 72 that meshes with the gear 68, gears 74 and 76 (see FIG. 4) that are coaxial with the gear 72, and a gear 78 that meshes with the gear 74. The transmission mechanism 330 also includes gears 80 and 82 (see FIG. 4) that are coaxial with the gear 78, and a gear 84 that meshes with the gear 82.

Figure 4:
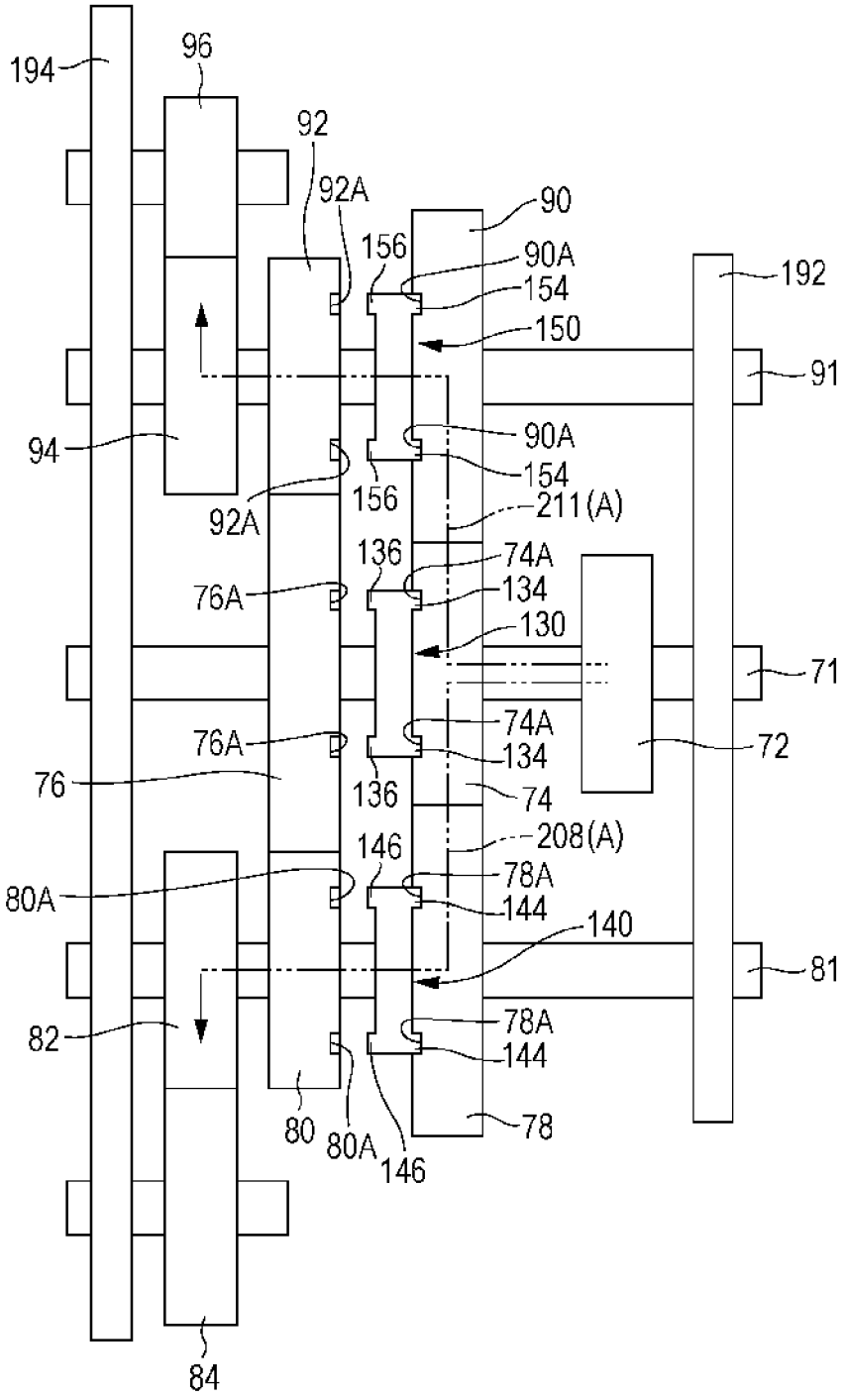
FIG. 4 is a schematic diagram illustrating a part of the drive mechanism according to the exemplary embodiment.
Figure 5:
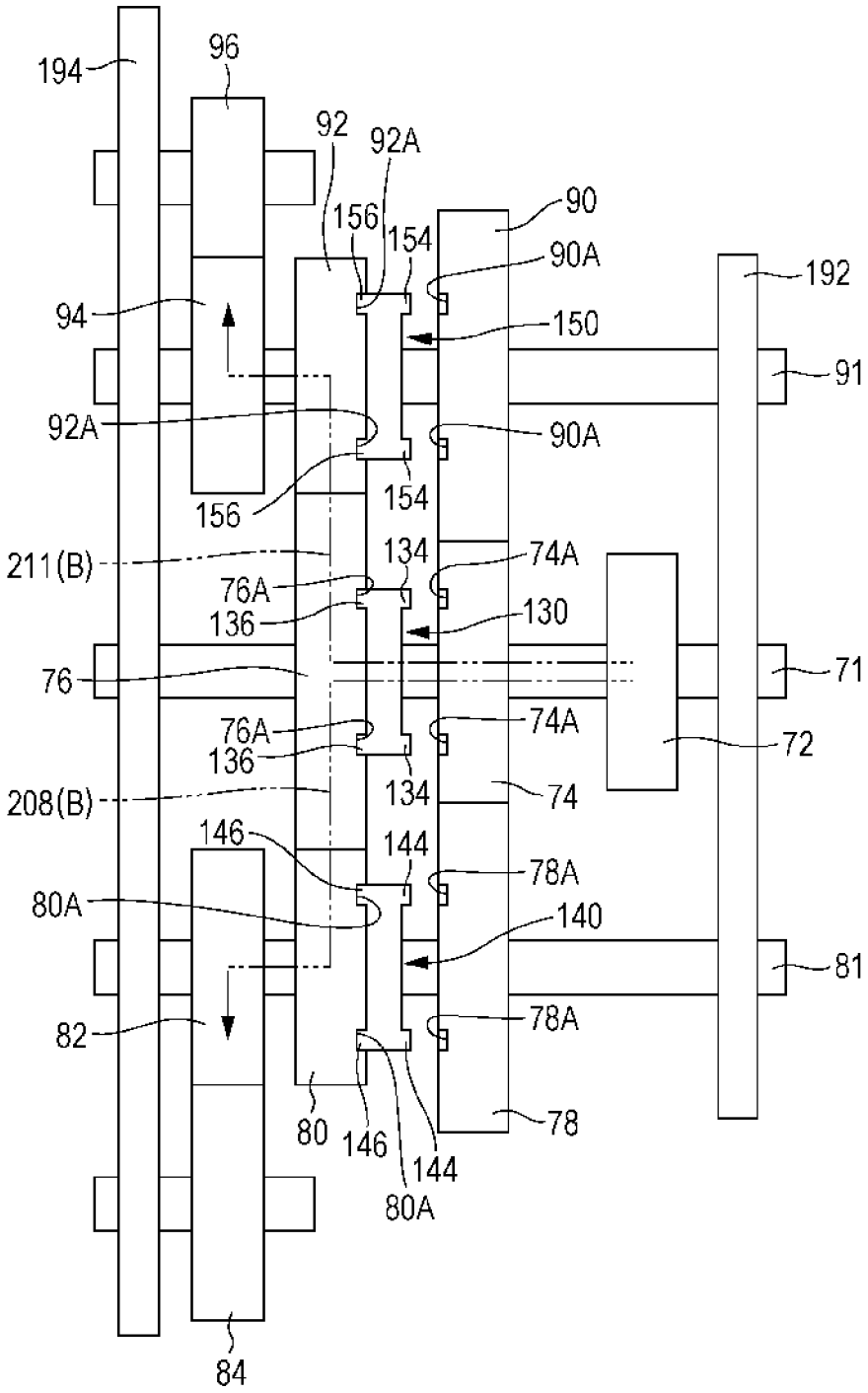
FIG. 5 is a schematic diagram illustrating the structure of FIG. 4 in the state in which couplings are connected to gears having different gear ratios.

As illustrated in FIGS. 4 and 5, the gear 72 is fixed to a rotating shaft 71 that is rotatably supported by support plates 192 and 194 (frame). The gears 74 and 76 are rotatably supported by the rotating shaft 71 such that movements thereof in the axial direction of the rotating shaft 71 are restricted (such that they are positioned in the axial direction of the rotating shaft 71).

The gear 82 is fixed to a rotating shaft 81 that is rotatably supported by the support plates 192 and 194. The gears 78 and 80 are rotatably supported by the rotating shaft 81 such that movements thereof in the axial direction of the rotating shaft 81 are restricted (such that they are positioned in the axial direction of the rotating shaft 81). The gear 80 meshes with the gear 76.

Couplings 130 and 140, which are included in a switching mechanism described below, are respectively arranged between the gears 74 and 76 and between the gears 78 and 80. The couplings 130 and 140 are switchable between a coupling state in which the couplings 130 and 140 are coupled to the gears 74 and 78, respectively (see FIG. 4), and a coupling state in which the couplings 130 and 140 are coupled to the gears 76 and 80, respectively (see FIG. 5). The structure of the switching mechanism will be described below.

In the coupling state illustrated in FIG. 4, rotations of the gears 74 and 78 around the rotating shafts 71 and 81, respectively, are restricted, so that the gears 74 and 78 rotate together with the rotating shafts 71 and 81, respectively. Therefore, in the coupling state illustrated in FIG. 4, the rotational force of the rotating shaft 71 is transmitted to the rotating shaft 81 through the gears 74 and 78.

Accordingly, in the coupling state illustrated in FIG. 4, a first path (example of a first drive path) along which the driving force of the drive motor 62 is transmitted to the registration roller 50A is formed. More specifically, the driving force of the drive motor 62 is transmitted to the registration roller 50A along the first path through a gear train including the drive gear 64, the gears 68, 72, 74, 78, 82, and 84, and a gear (not shown) fixed to a rotating shaft of the registration roller 50A. In FIG. 2, a portion of the first path from the drive gear 64 to the gear 84 is shown by two-dot chain lines 202, 206, 208 (208(A) in FIG. 4), and 210.

In the coupling state illustrated in FIG. 5, rotations of the gears 76 and 80 around the rotating shafts 71 and 81, respectively, are restricted, so that the gears 76 and 80 rotate together with the rotating shafts 71 and 81, respectively. Therefore, in the coupling state illustrated in FIG. 5, the rotational force of the rotating shaft 71 is transmitted to the rotating shaft 81 through the gears 76 and 80.

Accordingly, in the coupling state illustrated in FIG. 5, a second path (example of a second drive path) along which the driving force of the drive motor 62 is transmitted to the registration roller 50A is formed. More specifically, the driving force of the drive motor 62 is transmitted to the registration roller 50A along the second path through a gear train including the drive gear 64, the gears 68, 72, 76, 80, 82, and 84, and the gear (not shown) fixed to the rotating shaft of the registration roller 50A. In FIG. 2, a portion of the second path from the drive gear 64 to the gear 84 is shown by two-dot chain lines 202, 206, 208 (208(B) in FIG. 5), and 210.

The gear ratio between the gears 76 and 80 included in the gear train of the second path differs from the gear ratio between the gears 74 and 78 included in the gear train of the first path, and the number of revolutions of the gear 80 corresponding to a single revolution of the gear 76 is greater than the number of revolutions of the gear 78 corresponding to a single revolution of the gear 74. Therefore, the rotational speed of the registration roller 50A and the transport speed of the recording medium P are higher in the case where the driving force of the drive motor 62 is transmitted along the second path than in the case where the driving force of the drive motor 62 is transmitted along the first path.

When the driving force of the drive motor 62 is transmitted to the registration roller 50A along the first path, the gears 76 and 80 idly rotate around the rotating shafts 71 and 81, respectively. When the driving force of the drive motor 62 is transmitted to the registration roller 50A along the second path, the gears 74 and 78 idly rotate around the rotating shafts 71 and 81, respectively.

Thus, in the present exemplary embodiment, the transmission mechanism 330 that transmits the driving force of the drive motor 62 to the registration roller 50A includes the first and second paths having different gear ratios.

Transmission Mechanism 340 for Transmitting Driving Force of Drive Motor 62 to Heating Roller 56A As illustrated in FIGS. 2 and 3, the transmission mechanism 340 (example of a second transmission mechanism) includes the drive gear 64, the gears 68, 72, 74, and 76 (see FIG. 4), a gear 90 that meshes with the gear 74, and gears 92 and 94 (see FIG. 4) that are coaxial with the gear 90. The transmission mechanism 340 also includes a gear 96 that meshes with the gear 94, a gear 98 that meshes with the gear 96, a gear 100 that is coaxial with the gear 98, and a gear 102 that meshes with the gear 100. The gears 98 and 100 are fixed to a rotating shaft 103 (see FIG. 6).

As illustrated in FIGS. 4 and 5, the gear 94 is fixed to a rotating shaft 91 that is rotatably supported by the support plates 192 and 194. The gears 90 and 92 are rotatably supported by the rotating shaft 91 such that movements thereof in the axial direction of the rotating shaft 91 are restricted (such that they are positioned in the axial direction of the rotating shaft 91). The gear 92 meshes with the gear 76.

A coupling 150, which is included in the switching mechanism described below, is arranged between the gears 90 and 92. Similar to the couplings 130 and 140, as described below, the coupling 150 is switchable between a coupling state in which the coupling 150 is coupled to the gear 90 (see FIG. 4) and a coupling state in which the coupling 150 is coupled to the gear 92 (see FIG. 5).

In the coupling state illustrated in FIG. 4, rotations of the gears 74 and 90 around the rotating shafts 71 and 91, respectively, are restricted, so that the gears 74 and 90 rotate together with the rotating shafts 71 and 91, respectively. Therefore, in the coupling state illustrated in FIG. 4, the rotational force of the rotating shaft 71 is transmitted to the rotating shaft 91 through the gears 74 and 90.

Accordingly, in the coupling state illustrated in FIG. 4, a third path (example of a first drive path) along which the driving force of the drive motor 62 is transmitted to the heating roller 56A is formed. More specifically, the driving force of the drive motor 62 is transmitted to the heating roller 56A along the third path through a gear train including the drive gear 64, the gears 68, 72, 74, 90, 94, 96, 98, 100, and 102, and a gear (not shown) fixed to a rotating shaft of the heating roller 56A. In FIG. 2, a portion of the third path from the drive gear 64 to the gear 102 is shown by two-dot chain lines 202, 206, 211 (211 (A) in FIG. 4), 212, 214, and 216.

In the coupling state illustrated in FIG. 5, rotations of the gears 76 and 92 around the rotating shafts 71 and 91, respectively, are restricted, so that the gears 76 and 92 rotate together with the rotating shafts 71 and 91, respectively. Therefore, in the coupling state illustrated in FIG. 5, the rotational force of the rotating shaft 71 is transmitted to the rotating shaft 91 through the gears 76 and 92.

Accordingly, in the coupling state illustrated in FIG. 5, a fourth path (example of a second drive path) along which the driving force of the drive motor 62 is transmitted to the heating roller 56A is formed. More specifically, the driving force of the drive motor 62 is transmitted to the heating roller 56A along the fourth path through a gear train including the drive gear 64, the gears 68, 72, 76, 92, 94, 96, 98, 100, and 102, and the gear (not shown) fixed to the rotating shaft of the heating roller 56A. In FIG. 2, a portion of the fourth path from the drive gear 64 to the gear 102 is shown by two-dot chain lines 202, 206, 211 (211 (B) in FIG. 5), 212, 214, and 216.

The gear ratio between the gears 76 and 92 included in the gear train of the fourth path differs from the gear ratio between the gears 74 and 90 included in the gear train of the third path, and the number of revolutions of the gear 92 corresponding to a single revolution of the gear 76 is greater than the number of revolutions of the gear 90 corresponding to a single revolution of the gear 74. Therefore, the rotational speed of the heating roller 56A and the transport speed of the recording medium P are higher in the case where the driving force of the drive motor 62 is transmitted along the fourth path than in the case where the driving force of the drive motor 62 is transmitted along the third path.

When the driving force of the drive motor 62 is transmitted to the heating roller 56A along the third path, the gears 76 and 92 idly rotate around the rotating shafts 71 and 91, respectively. When the driving force of the drive motor 62 is transmitted to the heating roller 56A along the fourth path, the gears 74 and 90 idly rotate around the rotating shafts 71 and 91, respectively.

Thus, in the present exemplary embodiment, the transmission mechanism 340 that transmits the driving force of the drive motor 62 to the heating roller 56A includes the third and fourth paths having different gear ratios.

Switching Mechanism 350 for Switching Paths of Transmission Mechanisms 330 and 340

The drive mechanism 60 further includes a switching mechanism 350 that switches the paths of the transmission mechanisms 330 and 340. The switching mechanism 350 is controlled by the controller 20, and is operated by the driving force of the drive motor 62 so as to switch the path of the transmission mechanism 330 between the first and third paths and the path of the transmission mechanism 340 between the third and fourth paths.

Figure 6:
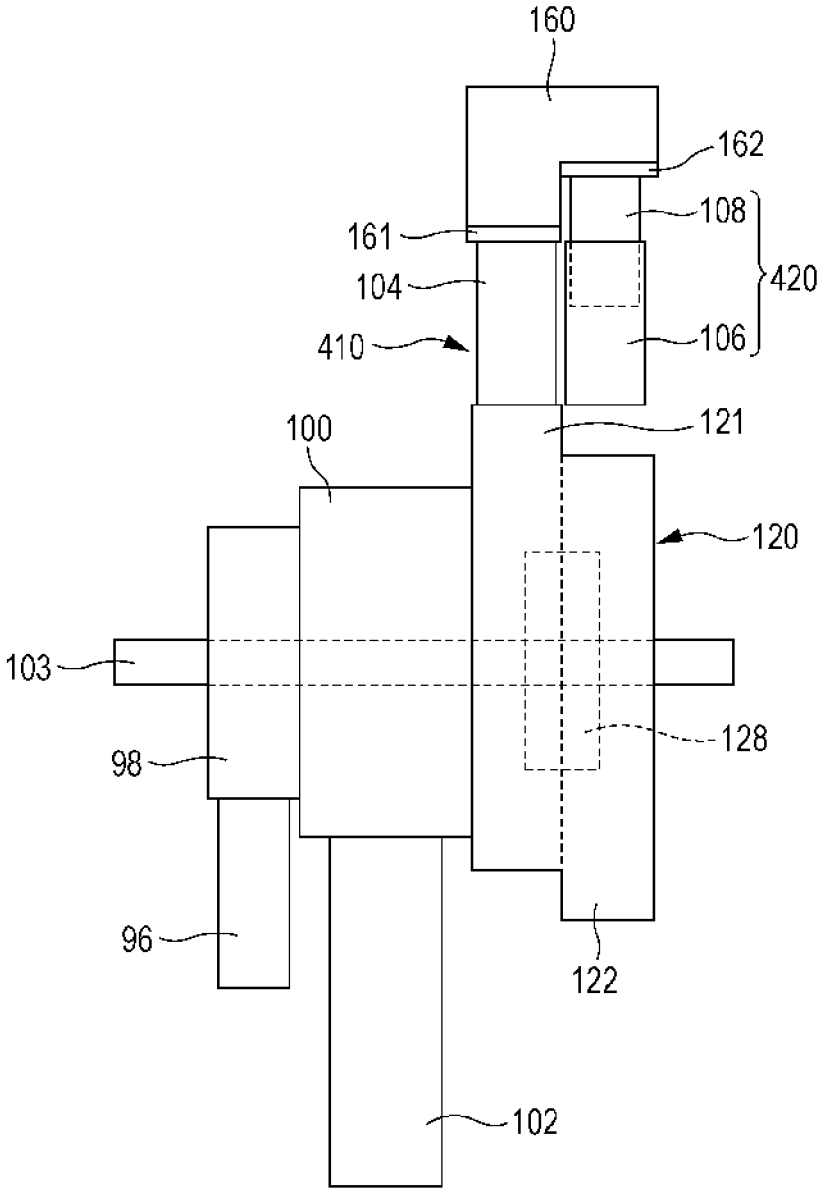
FIG. 6 is a schematic diagram illustrating the structure of a switching mechanism according to the exemplary embodiment.
Figure 7:
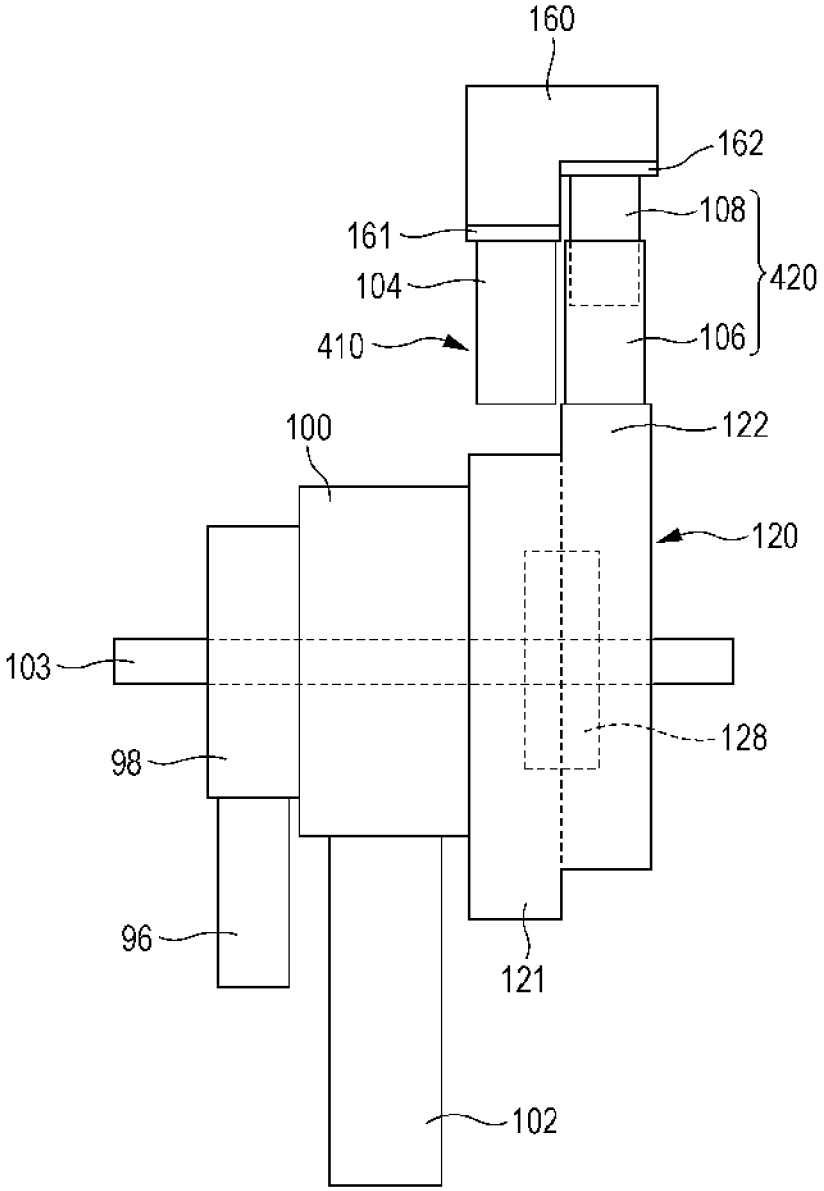
FIG. 7 is a schematic diagram illustrating the structure of FIG. 6 in the state in which second teeth of a double gear mesh with a gear.
Figure 8:
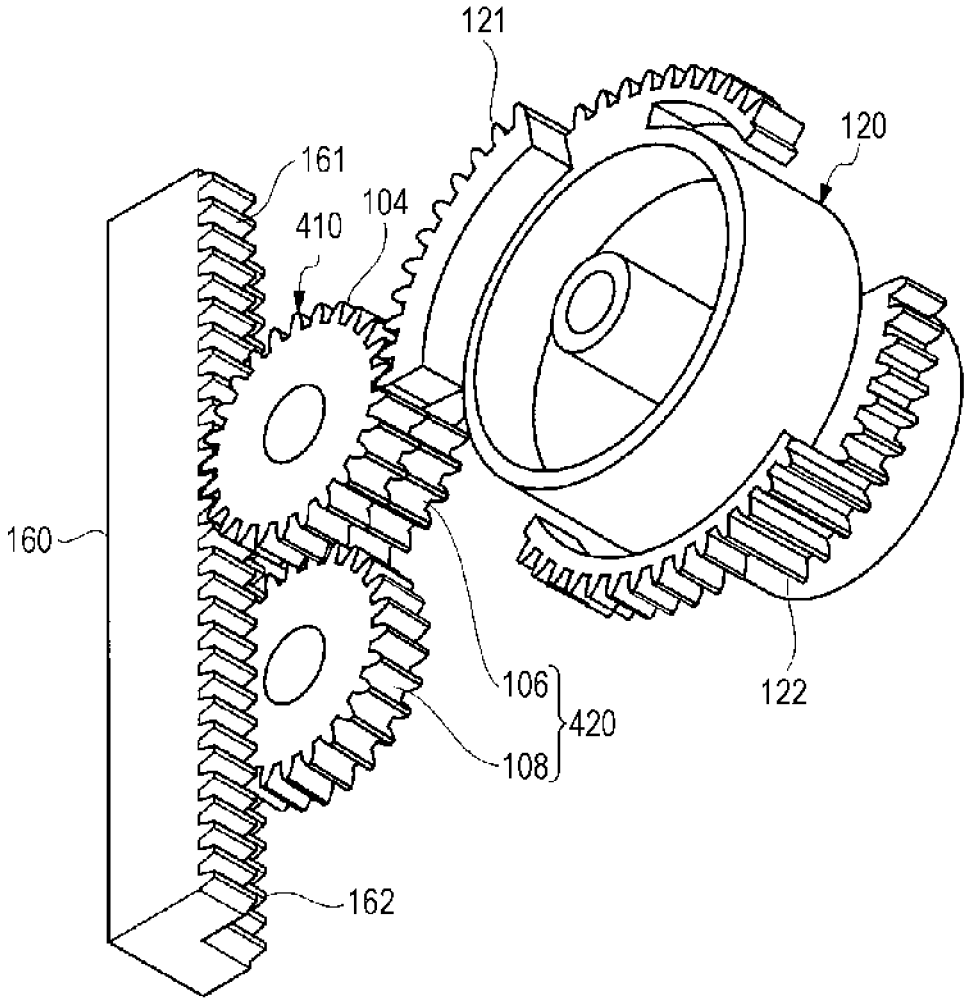
FIG. 8 is a perspective view illustrating the structure of the switching mechanism according to the exemplary embodiment.

More specifically, as illustrated in FIGS. 6, 7, and 8, the switching mechanism 350 includes a double gear 120 that is coaxial with the gear 98, which is included in the transmission mechanism 340, a rack 160 (example of a moving member), and transmitting units 410 and 420 that transmit the driving force of the double gear 120 to the rack 160. As illustrated in FIGS. 4 and 5, the switching mechanism 350 also includes couplings 130, 140, and 150 (examples of coupling members) arranged on the rotating shafts 71, 81, and 91, respectively.

As illustrated in FIGS. 6, 7, and 8, the transmitting unit 410 (example of a first transmitting unit) includes only a gear 104 that meshes with first teeth 121 of the double gear 120, which will be described below, and is composed of a single gear. The number of gears included in the transmitting unit 410 may instead be an odd number other than one.

The transmitting unit 420 (example of a second transmitting unit) includes a gear 106 that meshes with second teeth 122 of the double gear 120, which will be described below, and a gear 108 that meshes with the gear 106. Thus, the transmitting unit 420 is composed of two gears. The gears 106 and 104 are arranged on the same axial line so as to be independently rotatable. The number of gears included in the transmitting unit 420 may instead be an even number other than two.

Alternatively, the number of gears included in the transmitting unit 420 and the number of gears included in the transmitting unit 410 may be an odd number and an even number, respectively. In such a case, the transmitting unit 420 functions as an example of a first transmitting unit, and the transmitting unit 410 functions as an example of a second transmitting unit. The gears 106 and 104 may instead be arranged on different axial lines.

As illustrated in FIGS. 6 and 7, the double gear 120 is supported by the rotating shaft 103 that is rotatably supported by a support (frame) (not shown). An electromagnetic clutch 128 is mounted in the double gear 120. The electromagnetic clutch 128 switches the state of the double gear 120 between a state in which the double gear 120 rotates together with the rotating shaft 103 and a state in which the double gear 120 rotates with respect to the rotating shaft 103.

The first teeth 121 of the double gear 120 are disposed at one side of the double gear 120 in the axial direction (left side in FIGS. 6 and 7), and the second teeth 122 of the double gear 120 is disposed at the other side of the double gear 120 in the axial direction (right side in FIGS. 6 and 7).

As illustrated in FIG. 8, the first teeth 121 are formed along a part of the outer periphery of the double gear 120. The second teeth 122 are formed along a part of the outer periphery of the double gear 120 so as to oppose the first teeth 121 with the rotating shaft 103 provided therebetween. More specifically, the first teeth 121 are formed over a part of the double gear 120 corresponding to a range of 120 degrees, and the second teeth 122 are also formed over a part of the double gear 120 corresponding to a range of 120 degrees. Thus, the double gear 120 includes the first teeth 121 and the second teeth 122, which are arranged at different positions in both the axial direction and the peripheral direction of the double gear 120.

The double gear 120 is structured such that the state thereof may be switched between a state in which the first teeth 121 mesh with the gear 104, a state in which the second teeth 122 mesh with the gear 106, and a state in which neither the first teeth 121 nor the second teeth 122 mesh with a gear depending on the rotational position thereof. More specifically, when the double gear 120 is at a first rotational position at which the first teeth 121 oppose the gear 104, the first teeth 121 mesh with the gear 104, as illustrated in FIG. 6. When the double gear 120 is at a second rotational position at which the second teeth 122 oppose the gear 106, the second teeth 122 mesh with the gear 106, as illustrated in FIG. 7.

In the present exemplary embodiment, the rotational position of the double gear 120 is determined by the controller 20 on the basis of the driving amount of the drive motor 62 in the state in which the double gear 120 is set so as to rotate together with the rotating shaft 103 by the electromagnetic clutch 128. The rotational position of the double gear 120 may instead be determined by using a detector, such as an optical sensor, disposed around the double gear 120.

The rack 160 includes first teeth 161 that mesh with the gear 104, and second teeth 162 that mesh with the gear 108. The first teeth 161 are on the double-gear-120 side (left side in FIG. 2) of the second teeth 162.

The rack 160 is supported by the support (frame) (not shown) such that the rack 160 is movable in the up-down direction in FIG. 2. The rack 160 moves downward when the gear 104 that meshes with the first teeth 161 rotates clockwise in FIG. 2, and moves upward when the gear 108 that meshes with the second teeth 162 rotates counterclockwise.

The rack 160 has grooves 163, 164, and 165 in which arms 138, 148, and 158 of the couplings 130, 140, and 150, which will be described below, are respectively inserted. The grooves 163, 164, and 165 are formed in the rack 160 in the order of the groove 165, the groove 163, and the groove 164 from the top. Each of the grooves 163, 164, and 165 opens at the left side in FIG. 2.

As illustrated in FIGS. 4 and 5, the coupling 130 is supported by the rotating shaft 71 such that the coupling 130 is movable between the gears 74 and 76 in the axial direction of the rotating shaft 71. The coupling 130 includes projecting connecting portions 134, which are engageable with recessed connecting portions 74A formed in the gear 74, at one side thereof (right side in FIGS. 4 and 5) in the axial direction, and projecting connecting portions 136, which are engageable with recessed connecting portions 76A formed in the gear 76, at the other side thereof (left side in FIGS. 4 and 5) in the axial direction.

When the projecting connecting portions 134 are inserted into the recessed connecting portions 74A, the connecting portions 134 engage with the connecting portions 74A such that relative rotation therebetween is restricted. When the projecting connecting portions 136 are inserted into the recessed connecting portions 76A, the connecting portions 136 engage with the connecting portions 76A such that relative rotation therebetween is restricted. The structure may instead be such that the connecting portions 74A are projecting connecting portions and the connecting portions 134 are recessed connecting portions. This also applies to the relationship between the connecting portions 76A and the connecting portions 136.

In addition, as illustrated in FIG. 2, the coupling 130 includes the arm 138 (projecting portion) that projects outward in the radial direction. The arm 138 is inserted into the groove 163 in the rack 160. When the rack 160 moves in the up-down direction, the coupling 130 is rotated within a predetermined rotational angle range. More specifically, the coupling 130 is rotated between the rotational position illustrated in FIG. 2 and the rotational position illustrated in FIG. 3. As a result of the rotation, the coupling 130 is moved in one direction or the other along the axial direction of the rotating shaft 71. When the coupling 130 is at the rotational position illustrated in FIG. 2, the connecting portions 134 of the coupling 130 are inserted into the connecting portions 74A of the gear 74 and engage with the connecting portions 74A. When the coupling 130 is at the rotational position illustrated in FIG. 3, the connecting portions 136 of the coupling 130 are inserted into the connecting portions 76A of the gear 76 and engage with the connecting portions 76A. A mechanical element, such as a cam, capable of converting a rotational movement into a linear movement is provided to move the coupling 130 in one direction or the other along the axial direction of the rotating shaft 71 in response to the rotation between the rotational position illustrated in FIG. 2 and the rotational position illustrated in FIG. 3.

The structures of the couplings 140 and 150 are similar to that of the coupling 130. The rotating shaft 71, the connecting portions 134 and 136, the connecting portions 74A and 76A, the arm 138, and the groove 163 included in the above-described coupling 130 respectively correspond to the rotating shaft 81, connecting portions 144 and 146, connecting portions 78A and 80A, the arm 148, and the groove 164 in the coupling 140.

Therefore, when the coupling 140 is at the rotational position illustrated in FIG. 2, the connecting portions 144 of the coupling 140 are inserted into the connecting portions 78A of the gear 78 and engage with the connecting portions 78A, as illustrated in FIG. 4. When the coupling 140 is at the rotational position illustrated in FIG. 3, the connecting portions 146 of the coupling 140 are inserted into the connecting portions 80A of the gear 80 and engage with the connecting portions 80A, as illustrated in FIG. 5.

The rotating shaft 71, the connecting portions 134 and 136, the connecting portions 74A and 76A, the arm 138, and the groove 163 included in the above-described coupling 130 respectively correspond to the rotating shaft 91, connecting portions 154 and 156, connecting portions 90A and 92A, the arm 158, and the groove 165 in the coupling 150.

Therefore, when the coupling 150 is at the rotational position illustrated in FIG. 2, the connecting portions 154 of the coupling 150 are inserted into the connecting portions 90A of the gear 90 and engage with the connecting portions 90A, as illustrated in FIG. 4. When the coupling 150 is at the rotational position illustrated in FIG. 3, the connecting portions 156 of the coupling 150 are inserted into the connecting portions 92A of the gear 92 and engage with the connecting portions 92A, as illustrated in FIG. 5.

In the switching mechanism 350, the paths of the transmission mechanisms 330 and 340 are switched from the second and fourth paths, respectively, to the first and third paths, respectively, as follows.

That is, in the switching mechanism 350, in the state in which the double gear 120 is set so as to rotate together with the rotating shaft 103 by the electromagnetic clutch 128, the double gear 120 is rotated by the driving force of the drive motor 62 transmitted through the drive gear 64 and the gears 68, 72, 76, 92, 94, 96, and 98.

At this time, the rotational position of the double gear 120 is controlled by the controller 20. When the double gear 120 is rotated while the first teeth 121 of the double gear 120 mesh with the gear 104, the rack 160 is moved downward. When the rack 160 is moved downward, the couplings 130, 140, and 150 are rotated to the rotational position illustrated in FIG. 2. When the couplings 130, 140, and 150 are at the rotational position illustrated in FIG. 2, the connecting portions 134, 144, and 154 of the couplings 130, 140, and 150 engage with the connecting portions 74A, 78A, and 90A, respectively, as illustrated in FIG. 4. In this state, rotations of the gears 74, 78, and 90 relative to the rotating shafts 71, 81, and 91, respectively, are restricted, and the gears 74, 78, and 90 rotate together with the rotating shafts 71, 81, and 91, respectively. In this state, the gears 76, 80, and 92 idly rotate around the rotating shafts 71, 81, and 91, respectively.

In the switching mechanism 350, the paths of the transmission mechanisms 330 and 340 are switched from the first and third paths, respectively, to the second and fourth paths, respectively, as follows.

That is, in the switching mechanism 350, in the state in which the double gear 120 is set so as to rotate together with the rotating shaft 103 by the electromagnetic clutch 128, the double gear 120 is rotated by the driving force of the drive motor 62 transmitted through the drive gear 64 and the gears 68, 72, 74, 90, 94, 96, and 98.

At this time, the rotational position of the double gear 120 is controlled by the controller 20. When the double gear 120 is rotated while the second teeth 122 of the double gear 120 mesh with the gear 106, the gear 108 is rotated and the rack 160 is moved upward. When the rack 160 is moved upward, the couplings 130, 140, and 150 are rotated to the rotational position illustrated in FIG. 3. When the couplings 130, 140, and 150 are at the rotational position illustrated in FIG. 3, the connecting portions 136, 146, and 156 of the couplings 130, 140, and 150 engage with the connecting portions 76A, 80A, and 92A, respectively, as illustrated in FIG. 5. In this state, rotations of the gears 76, 80, and 92 relative to the rotating shafts 71, 81, and 91, respectively, are restricted, and the gears 76, 80, and 92 rotate together with the rotating shafts 71, 81, and 91, respectively. In this state, the gears 74, 78, and 90 idly rotate around the rotating shafts 71, 81, and 91, respectively.

In the initial state, for example, the transmission mechanisms 330 and 340 are set so as to transmit the driving force of the drive motor 62 through the second and fourth paths. When the controller 20 receives an image forming command (print command), the controller 20 carries out the switching operation as necessary before the execution of the image forming operation.

In the case where, for example, the transport speeds of the registration roller 50A and the fixing device 56 are to be set to reference speeds in the image forming operation, the paths are switched from the second and fourth paths to the first and third paths. An example of a case where the transport speeds of the registration roller 50A and the fixing device 56 are to be set to reference speeds is a case in which sheets of normal paper, which has a predetermined thickness, are selected as the recording media P through an operation unit (not shown).

In the case where the transport speeds of the registration roller 50A and the fixing device 56 are to be set to speeds higher than the reference speeds in the image forming operation, the paths are switched from the first and third paths to the second and fourth paths. An example of a case where the transport speeds of the registration roller 50A and the fixing device 56 are to be set to speeds higher than the reference speeds is a case where sheets of thick paper, which have a thickness greater than that of sheets of normal paper, are selected as the recording media P through the operation unit (not shown).

When the image forming operation is carried out, the electromagnetic clutch 128 switches the double gear 120 to a state in which the double gear 120 rotates with respect to the rotating shaft 103. Therefore, the double gear 120 idly rotates around the rotating shaft 103.

Operation of Present Exemplary Embodiment

A case in which the paths of the transmission mechanisms 330 and 340 are switched from the first and third paths, which are selected in the initial state, to the second and fourth paths will now be described.

In the case where, for example, sheets of thick paper are selected as the recording media P through the operation unit (not shown), when the controller 20 receives an image forming command, the controller 20 operates the switching mechanism 350 and switches the paths of the transmission mechanisms 330 and 340 from the first and third paths to the second and fourth paths. More specifically, the switching operation is performed as follows.

First, the electromagnetic clutch 128 mounted in the double gear 120 switches the double gear 120 to the state in which the double gear 120 rotates together with the rotating shaft 103. In this state, the double gear 120 is rotated by the driving force of the drive motor 62 transmitted through the drive gear 64 and the gears 68, 72, 74, 90, 94, 96, and 98.

At this time, the rotational position of the double gear 120 is controlled by the controller 20. When the double gear 120 is rotated while the second teeth 122 of the double gear 120 mesh with the gear 106, the gear 108 is rotated and the rack 160 is moved upward. When the rack 160 is moved upward, the couplings 130, 140, and 150 are rotated to the rotational position illustrated in FIG. 3. When the couplings 130, 140, and 150 are at the rotational position illustrated in FIG. 3, the connecting portions 136, 146, and 156 of the couplings 130, 140, and 150 engage with the connecting portions 76A, 80A, and 92A, respectively, as illustrated in FIG. 5.

In this state, rotations of the gears 76, 80, and 92 relative to the rotating shafts 71, 81, and 91, respectively, are restricted, and the gears 76, 80, and 92 rotate together with the rotating shafts 71, 81, and 91, respectively. In this state, the gears 74, 78, and 90 idly rotate around the rotating shafts 71, 81, and 91, respectively.

Next, the electromagnetic clutch 128 mounted in the double gear 120 switches the double gear 120 to the state in which the double gear 120 rotates with respect to the rotating shaft 103. Then, the image forming operation is performed as follows.

That is, the photoconductor drum 32 is charged by the charging roller 23 while being rotated. The charged photoconductor drum 32 is irradiated with light by the exposure device 36, so that an electrostatic latent image is formed on the surface of the photoconductor drum 32. The electrostatic latent image formed on the photoconductor drum 32 is developed with the developer supplied from the developing roller 38A that rotates. Thus, a black toner image is formed on the photoconductor drum 32.

The registration rollers 50A and 50B that rotate supply a sheet of thick paper, which serves as a recording medium P, to the transfer position T at the time when the toner image on the photoconductor drum 32 reaches the transfer position T. The black toner image on the photoconductor drum 32 is transferred onto the recording medium P at the transfer position T.

The recording medium P onto which the toner image has been transferred is transported from the transfer position T to the fixing device 56. The fixing device 56 fixes the toner image to the recording medium P by applying heat with the heating roller 56A and pressure with the pressing roller 56B while nipping the recording medium P between the heating roller 56A and the pressing roller 56B that rotate and transporting the recording medium P. The recording medium P to which the toner image is fixed is ejected to the ejection unit 18 by the ejection rollers 52.

In this image forming operation, the photoconductor drum 32 (see FIG. 1) is rotated by the driving force of the drive motor 62 transmitted to the photoconductor drum 32 by the transmission mechanism 310 including the gear train including the drive gear 64, the gear 66, and the gear (not shown) fixed to the rotating shaft of the photoconductor drum 32.

In addition, the developing roller 38A is rotated by the driving force of the drive motor 62 transmitted to the developing roller 38A by the transmission mechanism 320 including the gear train including the drive gear 64, the gears 68 and 70, and the gear (not shown) fixed to the rotating shaft of the developing roller 38A.

The driving force of the drive motor 62 is also transmitted to the registration roller 50A through the gear train including the drive gear 64, the gears 68, 72, 76, 80, 82, and 84, and the gear (not shown) fixed to the rotating shaft of the registration roller 50A. In other words, the registration roller 50A is rotated by the driving force transmitted thereto along the second path of the transmission mechanism 330. Accordingly, the rotational speed of the registration roller 50A is higher than that in the case where the driving force is transmitted along the first path. As a result, even when the recording medium P is a sheet of thick paper, which causes a higher transportation resistance than a sheet of normal paper, reduction of the transport speed of the recording medium P may be suppressed.

The driving force of the drive motor 62 is also transmitted to the heating roller 56A through the gear train including the drive gear 64, the gears 68, 72, 76, 92, 94, 96, 98, 100, and 102, and the gear (not shown) fixed to the rotating shaft of the heating roller 56A. In other words, the heating roller 56A is rotated by the driving force transmitted thereto along the fourth path of the transmission mechanism 340. Accordingly, the rotational speed of the heating roller 56A is higher than that in the case where the driving force is transmitted along the third path. As a result, even when the recording medium P is a sheet of thick paper, which causes a higher transportation resistance than a sheet of normal paper, reduction of the transport speed of the recording medium P may be suppressed.

Thus, according to the present exemplary embodiment, in the structure in which the photoconductor drum 32, the developing roller 38A, the registration roller 50A, and the heating roller 56A are driven by a single (common) drive motor 62, the paths of the transmission mechanisms 330 and 340 may be switched from the first and third paths to the second and fourth paths. In such a case, the rotational speeds of the registration roller 50A and the heating roller 56A may be changed without changing the rotational speeds of the photoconductor drum 32 and the developing roller 38A.

In addition, according to the present exemplary embodiment, as described above, the drive motor 62 used to rotate the photoconductor drum 32, the developing roller 38A, the registration roller 50A, and the heating roller 56A is used also as a drive source for operating the switching mechanism 350. Thus, in the present exemplary embodiment, in the case where the rotational speeds of the registration roller 50A and the heating roller 56A are to be changed without changing the rotational speeds of the photoconductor drum 32 and the developing roller 38A, not only the rotations of the photoconductor drum 32, the developing roller 38A, the registration roller 50A, and the heating roller 56A but also the operation of the switching mechanism 350 is performed by using the same drive unit (drive motor 62).

In addition, in the present exemplary embodiment, the rack 160 is moved downward by transmitting the driving force from the double gear 120 to the rack 160 through a single gear 104, and is moved upward by transmitting the driving force from the double gear 120 to the rack 160 through two gears 106 and 108. Thus, in the present exemplary embodiment, the rack 160 may be moved upward or downward to change the rotational speeds of the registration roller 50A and the heating roller 56A without rotating the drive motor 62 in a reverse direction.

Modifications

In the above-described exemplary embodiment, the photoconductor drum 32 and the developing roller 38A are described as examples of a first rotary member. However, the first rotary member may instead be another roller or belt as long as the first rotary member is a rotating member.

In addition, in the above-described exemplary embodiment, the registration roller 50A and the heating roller 56A are described as examples of a second rotary member. However, the second rotary member may instead be another roller, such as a transport roller, or a belt as long as the second rotary member is a rotating member.

In addition, in the above-described exemplary embodiment, the switching mechanism 350 includes the double gear 120, the rack 160, the transmitting units 410 and 420, and the couplings 130, 140, and 150. However, the switching mechanism 350 is not limited to this, and may include mechanical elements other than the above-described elements.

The present invention is not limited to the above-described exemplary embodiment, and various modifications, alterations, and improvements may be made within the gist of the present invention. For example, the above-described modifications may be applied in combination as appropriate.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A drive mechanism comprising:

a first transmission mechanism configured to transmit a driving force of a drive unit to a first rotary member to rotate the first rotary member;

a second transmission mechanism including:

a first drive path along which the second transmission mechanism is configured to transmit the driving force of the drive unit to a second rotary member through a first gear train to rotate the second rotary member; and a second drive path along which the second transmission mechanism is configured to transmit the driving force of the drive unit to the second rotary member through a second gear train to rotate the second rotary member, the second gear train having a gear ratio that differs from a gear ratio of the first gear train; and a switching mechanism configured to be operated by the driving force of the drive unit and to switch the second transmission mechanism between the first drive path and the second drive path, wherein the first rotary member is separate from the second transmission mechanism, and wherein the first rotary member comprises at least one of a photoconductor and a developing roller.

2. The drive mechanism according to claim 1, wherein the switching mechanism comprises a double gear.

3. The drive mechanism according to claim 1, wherein the switching mechanism comprises a rack.

4. The drive mechanism according to claim 1, wherein the first transmission mechanism is configured to transmit the driving force of the drive unit in a first direction to the first rotary member to rotate the first rotary member, and wherein the second transmission mechanism is configured to transmit the driving force of the drive unit in the first direction to the second rotary member through the first gear train to rotate the second rotary member.

5. The drive mechanism according to claim 4, wherein the second transmission mechanism is configured to transmit the driving force of the drive unit in the first direction to the second rotary member through the second gear train to rotate the second rotary member.

6. The drive mechanism according to claim 1, wherein the drive unit comprises a drive motor that only rotates in one direction.

7. The drive mechanism according to claim 1, wherein the drive mechanism is configured such that, when the switching mechanism is operated to switch the second transmission mechanism between the first drive path and the second drive path, a rotational speed of the second rotary member is changed without changing the rotational speed of the first rotary member.

8. A drive mechanism comprising:

a first transmission mechanism configured to transmit a driving force of a drive unit to a first rotary member to rotate the first rotary member;

a second transmission mechanism including:

a first drive path along which the second transmission mechanism is configured to transmit the driving force of the drive unit to a second rotary member through a first gear train to rotate the second rotary member; and a second drive path along which the second transmission mechanism is configured to transmit the driving force of the drive unit to the second rotary member through a second gear train to rotate the second rotary member, the second gear train having a gear ratio that differs from a gear ratio of the first gear train; and a switching mechanism configured to be operated by the driving force of the drive unit and to switch the second transmission mechanism between the first drive path and the second drive path, wherein the switching mechanism includes:

a double gear configured to be rotated in one direction by the driving force of the drive unit and that includes first teeth and second teeth, the first teeth and second teeth being disposed at different positions in an axial direction and at different positions in a peripheral direction;

a first transmitting unit including a first gear that meshes with the first teeth and is configured to rotate when the double gear is at a first rotational position;

a second transmitting unit including a second gear that meshes with the second teeth and is configured to rotate when the double gear is at a second rotational position that differs from the first rotational position;

a moving member configured to move in one direction when the moving member receives the driving force from the double gear through the first transmitting unit, and is configured to move in another direction when the moving member receives the driving force from the double gear through the second transmitting unit; and a coupling member configured to be coupled to a gear of the first gear train so that the gear of the first gear train rotates together with a rotating shaft that supports the gear of the first gear train when the moving member moves in the one direction, and configured to be coupled to a gear of the second gear train so that the gear of the second gear train rotates together with a rotating shaft that supports the gear of the second gear train when the moving member moves in the other direction.

9. An image forming apparatus comprising:

the drive mechanism according to claim 8;

a photoconductor configured to have an image to be transferred onto a recording medium formed thereon, wherein the first rotary member comprises the photoconductor; and the second rotary member rotated by the second transmission mechanism of the drive mechanism.

10. An image forming apparatus comprising:

a drive mechanism comprising:

a first transmission mechanism configured to transmit a driving force of a drive unit to a first rotary member to rotate the first rotary member;

a second transmission mechanism including:

a first drive path along which the second transmission mechanism is configured to transmit the driving force of the drive unit to a second rotary member through a first gear train to rotate the second rotary member; and a second drive path along which the second transmission mechanism is configured to transmit the driving force of the drive unit to the second rotary member through a second gear train to rotate the second rotary member, the second gear train having a gear ratio that differs from a gear ratio of the first gear train; and a switching mechanism configured to be operated by the driving force of the drive unit and to switch the second transmission mechanism between the first drive path and the second drive path;

a photoconductor configured to have an image to be transferred onto a recording medium formed thereon, wherein the first rotary member comprises the photoconductor; and the second rotary member rotated by the second transmission mechanism of the drive mechanism.

* * * * *